US009499934B2

(12) United States Patent
Ashrafzadeh et al.

(10) Patent No.: US 9,499,934 B2
(45) Date of Patent: Nov. 22, 2016

(54) LAUNDRY TREATING APPLIANCES AND METHODS OF CONTROLLING THE SAME TO DETERMINE AN END OF-CYCLE CONDITION

(71) Applicant: Whirlpool Corporation, Benton Harbor, MI (US)

(72) Inventors: Farhad Ashrafzadeh, Bowling Green, KY (US); Ryan R. Bellinger, Saint Joseph, MI (US); James P. Carow, Saint Joseph, MI (US); Moeed Mukhtar, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 714 days.

(21) Appl. No.: 13/869,378

(22) Filed: Apr. 24, 2013

(65) Prior Publication Data

US 2014/0317953 A1 Oct. 30, 2014

(51) Int. Cl.
*D06F 58/28* (2006.01)
*D06F 58/20* (2006.01)

(52) U.S. Cl.
CPC ..... *D06F 58/28* (2013.01); *D06F 58/203* (2013.01); *D06F 2058/289* (2013.01); *D06F 2058/2829* (2013.01); *D06F 2058/2861* (2013.01)

(58) Field of Classification Search
CPC ..... D06F 58/28; D06F 2058/2861; D06F 2058/289; D06F 2058/2829; D06F 58/203
See application file for complete search history.

(56) References Cited

U.S. PATENT DOCUMENTS

| | | | | |
|---|---|---|---|---|
| 4,549,362 | A * | 10/1985 | Haried | D06F 58/263 34/395 |
| 6,141,887 | A | 11/2000 | Chen et al. | |
| 7,941,937 | B2 | 5/2011 | Do | |
| 8,136,264 | B2 | 3/2012 | Bae et al. | |
| 2007/0214678 | A1 | 9/2007 | Son et al. | |
| 2009/0313848 | A1 | 12/2009 | Moschutz et al. | |
| 2010/0000022 | A1 | 1/2010 | Hendrickson et al. | |

FOREIGN PATENT DOCUMENTS

| | | | |
|---|---|---|---|
| CN | 101967746 | A | 2/2011 |
| EP | 0370875 | B1 | 5/1990 |
| EP | 2267214 | A1 | 12/2010 |

* cited by examiner

*Primary Examiner* — Jiping Lu

(57) ABSTRACT

Laundry treating appliances and methods of controlling the same to determine an end-of-cycle condition are disclosed. An example method of operating a laundry treating appliance having a treating chamber in which laundry is received for treatment, and a heated air system having a supply conduit coupled to the treating chamber and an exhaust conduit coupled to the treating chamber includes supplying heated air to the treating chamber via the supply conduit, exhausting air from the treating chamber via the exhaust conduit, repeatedly determining exhaust air temperatures of the air exhausted from the exhaust conduit, determining a windowed derivative of the exhaust air temperature values, determining a zero crossing of the windowed derivative, and initiating the termination of the supplying of heated air in response to the determination of the zero crossing.

3 Claims, 5 Drawing Sheets

LAUNDRY TREATING APPLIANCES AND METHODS OF CONTROLLING THE SAME TO DETERMINE AN END OF-CYCLE CONDITION

FIELD OF THE DISCLOSURE

This disclosure relates generally to laundry treating appliances, and, more particularly, to laundry treating appliances and methods of controlling the same to determine an end-of-cycle condition.

BACKGROUND

Laundry treating appliances, such as a clothes washer, a clothes dryer, a combination washer-dryer, a refresher and a non-aqueous system, may have a configuration based on a rotating drum that defines a treating chamber in which laundry items are placed for treating according to a cycle of operation. A dispensing system may be provided for dispensing a treating chemistry as part of the cycle of operation. A controller may be operably connected with the dispensing system and may have various components of the laundry treating appliance to execute the cycle of operation. The cycle of operation may be selected manually by the user or automatically based on one or more conditions determined by the controller.

SUMMARY

A disclosed example method of operating a laundry treating appliance having a treating chamber in which laundry is received for treatment, and a heated air system having a supply conduit coupled to the treating chamber and an exhaust conduit coupled to the treating chamber includes supplying heated air to the treating chamber via the supply conduit, exhausting air from the treating chamber via the exhaust conduit, repeatedly determining exhaust air temperatures of the air exhausted from the exhaust conduit, determining a windowed derivative of the exhaust air temperature values, determining a zero crossing of the windowed derivative, and initiating the termination of the supplying of heated air in response to the determination of the zero crossing.

A disclosed example laundry treating appliance includes a treating chamber in which laundry is to be received for treatment, a heated air system having a supply conduit to supply heated air to the treating chamber, and an exhaust conduit to exhaust air from the treating chamber, a sensor to determine exhaust air temperatures of the air exhausted via the exhaust conduit, and a controller programmed to determine a windowed derivative of the exhaust air temperature values, determine a zero crossing of the windowed derivative, and initiate the termination of the supplying of heated air in response to the determination of the zero crossing.

DETAILED DESCRIPTION

Figure 1:
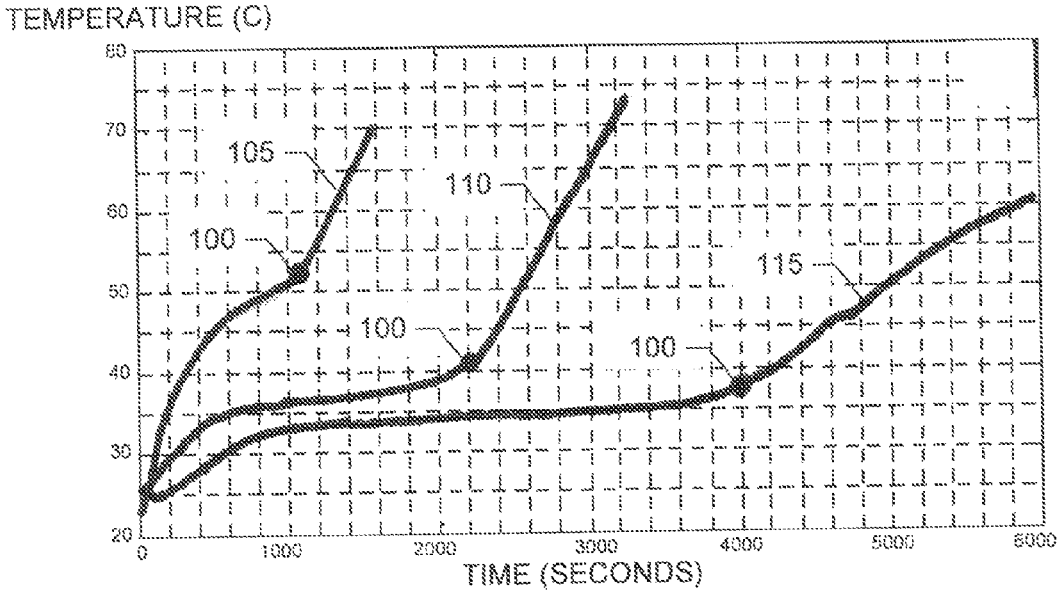
FIG. 1 is a graph depicting example exhaust air temperature profiles.

The state or point in a drying cycle when substantially all moisture has evaporated from the surface of the fabric in a laundry load, and the input heat energy primarily raises the temperature of the fabric, is known as critical moisture content state or point. As shown in FIG. 1, the slope of the temperature profile undergoes a significant increase past this critical moisture content point 100 compared to the preceding period when there is moisture present on the fabric surface. In FIG. 1, three temperature profiles 105, 110, 115 are shown corresponding to a 1 kilogram (kg) load, a 4 kg load and an 8 kg load, respectively. After determining the change in slope, remaining time needed for the drying process to finish can be determined using a load mass determined using load sensing or some other method. Also, after determining the critical moisture content state or point, the end of cycle behavior can be adjusted by, for example, lowering input power/usage of main actuators such as drum (speed), blower fan (speed), heater (temperature, duty cycle, electric power) to save energy and prevent overheating and/or over drying of the fabric. By more accurately determining the critical moisture content state or point, the examples disclosed herein may achieve greater energy savings, reduce the over drying of fabrics, provide better fabric care through cycle termination at a lower temperature, and/or can display a more accurate indication of the remaining cycle time. Because the examples disclosed herein can determine the critical moisture content state or point using only drum exhaust air temperature, the disclosed examples may be implemented without the complexity and cost of moisture sensing strips, inlet air temperature sensors, and/or humidity sensors. As used herein, "determining" means any manner, direct or indirect, by any actor, human or machine, by which a parameter or condition may be decided, which includes, without limitation sensing, calculating, estimating, experimenting, empirically, theoretically, mathematically, identifying, detecting, computing, measuring, reading an output of a sensor, and reading a sensor output from a memory.

Figure 2:
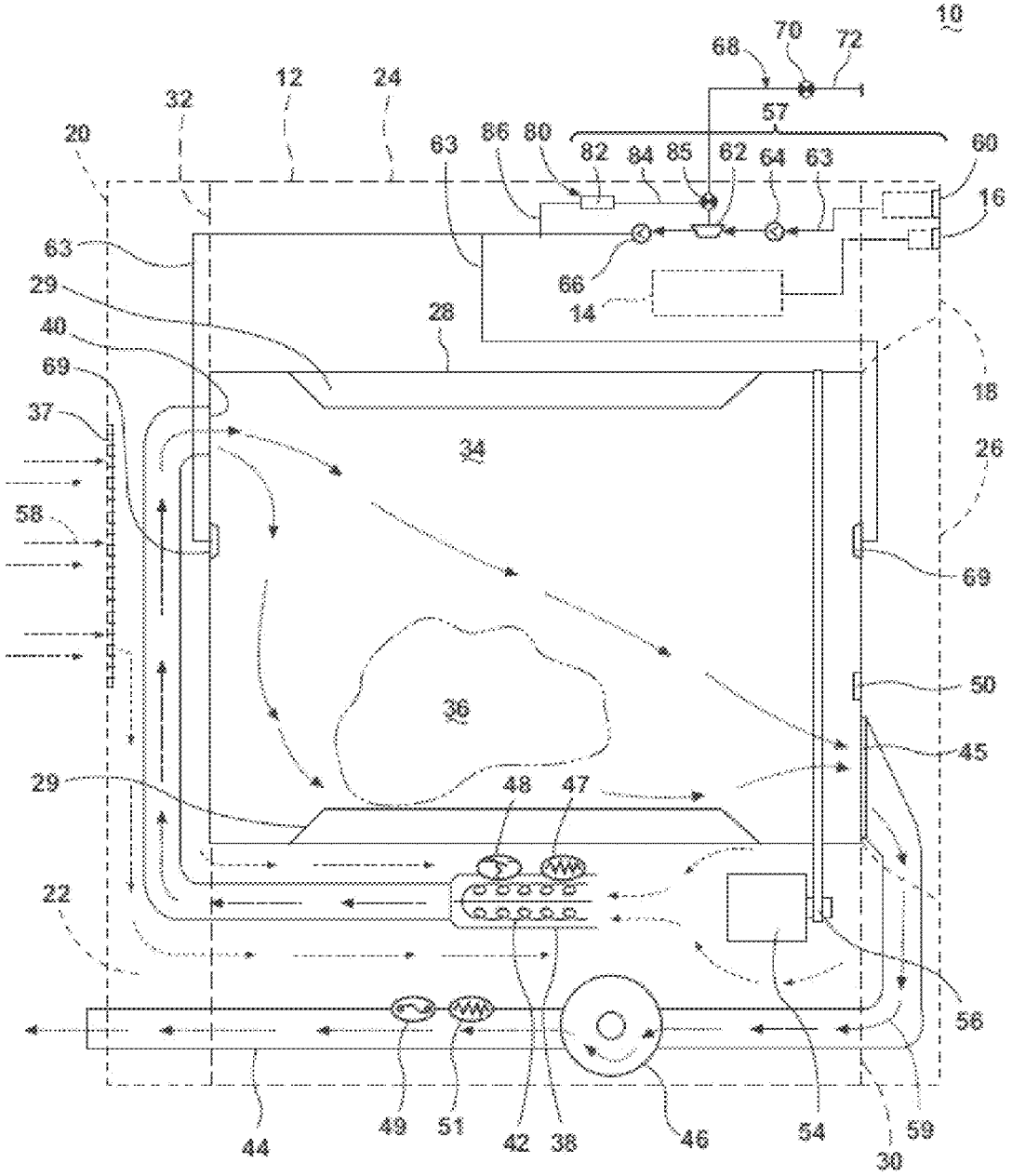
FIG. 2 is a schematic view of an example laundry treating appliance in the form of a clothes dryer.

FIG. 2 is a schematic view of an example laundry treating appliance 10 in the form of a clothes dryer 10. The clothes dryer 10 described herein shares many features of a traditional automatic clothes dryer, which will not be described in detail except as necessary for a complete understanding of this disclosure. While examples are described in the context of a clothes dryer 10, the examples disclosed herein may be used with any type of laundry treating appliance, non-limiting examples of which include a washing machine, a combination washing and drying machine, a non-aqueous system, and a refreshing/revitalizing machine.

As illustrated in FIG. 2, the clothes dryer 10 may include a cabinet 12 in which is provided a controller 14 that may receive input from a user through a user interface 16 for selecting a cycle of operation and controlling the operation of the clothes dryer 10 to implement the selected cycle of operation. As discussed in more detail below, the controller 14 may be programmed and/or configured to determine an end-of-cycle condition based on drum exhaust air temperatures, and to terminate and/or adjust drying based on the determined end-of-cycle condition.

The cabinet 12 may be defined by a front wall 18, a rear wall 20, and a pair of side walls 22 supporting a top wall 24. A chassis may be provided with the walls being panels mounted to the chassis. A door 26 may be hingedly mounted to the front wall 18 and may be selectively movable between opened and closed positions to close an opening in the front wall 18, which provides access to the interior of the cabinet 12.

A rotatable drum 28 may be disposed within the interior of the cabinet 12 between opposing stationary front and rear bulkheads 30, 32, which, along with the door 26, collectively define a treating chamber 34 for treating laundry. As illustrated, and as is the case with most clothes dryers, the treating chamber 34 is not fluidly coupled to a drain. Thus, any liquid introduced into the treating chamber 34 may not be removed merely by draining.

Non-limiting examples of laundry that may be treated according to a cycle of operation include, a hat, a scarf, a glove, a sweater, a blouse, a shirt, a pair of shorts, a dress, a sock, a pair of pants, a shoe, an undergarment, and a jacket. Furthermore, textile fabrics in other products, such as draperies, sheets, towels, pillows, and stuffed fabric articles (e.g., toys), may be treated in the clothes dryer 10.

The drum 28 may include at least one lifter 29. In most dryers, there may be multiple lifters. The lifters may be located along an inner surface of the drum 28 defining an interior circumference of the drum 28. The lifters may facilitate movement of the laundry 36 within the drum 28 as the drum 28 rotates.

The drum 28 may be operably coupled with a motor 54 to selectively rotate the drum 28 during a cycle of operation. The coupling of the motor 54 to the drum 28 may be direct or indirect. As illustrated, an indirect coupling may include a belt 56 coupling an output shaft of the motor 54 to a wheel/pulley on the drum 28. A direct coupling may include the output shaft of the motor 54 coupled to a hub of the drum 28.

An air system may be provided to the clothes dryer 10. The air system supplies air to the treating chamber 34 and exhausts air from the treating chamber 34. The supplied air may be heated or not. The air system may have an air supply portion that may form, in part, a supply conduit 38, which has one end open to ambient air via a rear vent 37 and another end fluidly coupled to an inlet grill 40, which may be in fluid communication with the treating chamber 34. A heating element 42 may lie within the supply conduit 38 and may be operably coupled to and controlled by the controller 14. If the heating element 42 is turned on, the supplied air will be heated prior to entering the drum 28.

The air system may further include an air exhaust portion that may be formed in part by an exhaust conduit 44. A lint trap 45 may be provided as the inlet from the treating chamber 34 to the exhaust conduit 44. A blower 46 may be fluidly coupled to the exhaust conduit 44. The blower 46 may be operably coupled to and controlled by the controller 14. Operation of the blower 46 draws air into the treating chamber 34 as well as exhausts air from the treating chamber 34 through the exhaust conduit 44. The exhaust conduit 44 may be fluidly coupled with a household exhaust duct (not shown) for exhausting the air from the treating chamber 34 to the outside of the clothes dryer 10.

The air system may further include various sensors and other components, such as a thermistor 47 and a thermostat 48, which may be coupled to the supply conduit 38 in which the heating element 42 may be positioned. The thermistor 47 and the thermostat 48 may be operably coupled to each other. Alternatively, the thermistor 47 may be coupled to the supply conduit 38 at or near to the inlet grill 40. Regardless of its location, the thermistor 47 may be used to aid in determining an inlet temperature. A thermistor 51 and a thermal fuse 49 may be coupled to the exhaust conduit 44. The thermistor 51 may be used to determine an outlet or exhaust air temperature.

A moisture sensor 50 may be positioned in the interior of the treating chamber 34 to monitor the amount of moisture of the laundry in the treating chamber 34. One example of a moisture sensor 50 is a conductivity strip. The moisture sensor 50 may be operably coupled to the controller 14 such that the controller 14 receives output from the moisture sensor 50. The moisture sensor 50 may be mounted at any location in the interior of the dispensing dryer 10 such that the moisture sensor 50 may be able to accurately sense the moisture content of the laundry. For example, the moisture sensor 50 may be coupled to one of the bulkheads 30, 32 of the drying chamber 34 by any suitable means.

A dispensing system 57 may be provided to the clothes dryer 10 to dispense one or more treating chemistries to the treating chamber 34 according to a cycle of operation. As illustrated, the dispensing system 57 may be located in the interior of the cabinet 12 although other locations are also possible. The dispensing system 57 may be fluidly coupled to a water supply 68. The dispensing system 57 may be further coupled to the treating chamber 34 through one or more nozzles 69. As illustrated, nozzles 69 are provided to the front and rear of the treating chamber 34 to provide the treating chemistry or liquid to the interior of the treating chamber 34, although other configurations are also possible. The number, type and placement of the nozzles 69 are not germane to this disclosure.

As illustrated, the dispensing system 57 may include a reservoir 60, which may be a cartridge, for a treating chemistry that is releasably coupled to the dispensing system 57, which dispenses the treating chemistry from the reservoir 60 to the treating chamber 34. The reservoir 60 may include one or more cartridges configured to store one or more treating chemistries in the interior of cartridges. A suitable cartridge system may be found in U.S. Pub. No. 2010/0000022 to Hendrickson et al., filed Jul. 1, 2008, entitled "Household Cleaning Appliance with a Dispensing System Operable Between a Single Use Dispensing System and a Bulk Dispensing System," which is herein incorporated by reference in its entirety.

A mixing chamber 62 may be provided to couple the reservoir 60 to the treating chamber 34 through a supply conduit 63. Pumps such as a metering pump 64 and delivery pump 66 may be provided to the dispensing system 57 to selectively supply a treating chemistry and/or liquid to the treating chamber 34 according to a cycle of operation. The water supply 68 may be fluidly coupled to the mixing chamber 62 to provide water from the water source to the mixing chamber 62. The water supply 68 may include an inlet valve 70 and a water supply conduit 72. It is noted that, instead of water, a different treating chemistry may be provided from the exterior of the clothes dryer 10 to the mixing chamber 62.

The treating chemistry may be any type of aid for treating laundry, non-limiting examples of which include, but are not limited to, water, fabric softeners, sanitizing agents, de-wrinkling or anti-wrinkling agents, and chemicals for imparting desired properties to the laundry, including stain resistance, fragrance (e.g., perfumes), insect repellency, and UV protection.

The dryer 10 may also be provided with a steam generating system 80 that may be separate from the dispensing system 57 or integrated with portions of the dispensing system 57 for dispensing steam and/or liquid to the treating chamber 34 according to a cycle of operation. The steam generating system 80 may include a steam generator 82 fluidly coupled with the water supply 68 through a steam inlet conduit 84. A fluid control valve 85 may be used to control the flow of water from the water supply conduit 72 between the steam generating system 80 and the dispensing system 57. The steam generator 82 may further be fluidly coupled with the one or more supply conduits 63 through a steam supply conduit 86 to deliver steam to the treating chamber 34 through the nozzles 69. Alternatively, the steam generator 82 may be coupled with the treating chamber 34 through one or more conduits and nozzles independently of the dispensing system 57.

The steam generator 82 may be any type of device that converts the supplied liquid to steam. For example, the steam generator 82 may be a tank-type steam generator that stores a volume of liquid and heats the volume of liquid to convert the liquid to steam. Alternatively, the steam generator 82 may be an in-line steam generator that converts the liquid to steam as the liquid flows through the steam generator 82.

It will be understood that the details of the dispensing system 57 and steam generating system 80 are not germane to this disclosure and that any suitable dispensing system and/or steam generating system may be used with the dryer 10. It is also within the scope of this disclosure for the dryer 10 to not include a dispensing system or a steam generating system.

Figure 3:
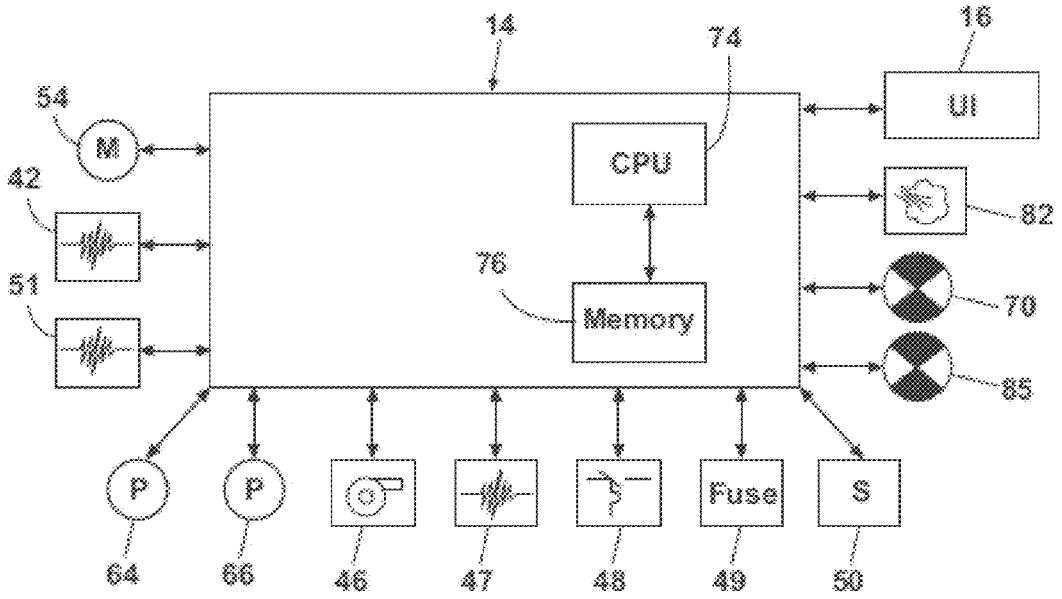
FIG. 3 is a schematic view of an example manner of implementing the example controller of FIG. 2.

FIG. 3 is a schematic view of an example manner of implementing the example controller 14 of FIG. 2. As shown in FIG. 3, the controller 14 is coupled to various components of the dryer 10. The controller 14 may be communicably coupled to components of the clothes dryer 10 such as the heating element 42, the blower 46, the thermistor 47, the thermostat 48, the thermal fuse 49, the thermistor 51, the moisture sensor 50, the motor 54, the inlet valve 70, the pumps 64, 66, the steam generator 82 and the fluid control valve 85 to either control these components and/or receive their input for use in controlling the components. The controller 14 is also operably coupled to the user interface 16 to receive input from the user through the user interface 16 for the implementation of the drying cycle and provide the user with information regarding the drying cycle. An example method that may be carried out by the controller 14 to determine an end-of-cycle condition, and to terminate and/or adjust a drying processed based on the end-of-cycle condition is described below in connection with FIG. 4.

The user interface 16 may be provided having operational controls such as dials, lights, knobs, levers, buttons, switches, and displays enabling the user to input commands to a controller 14 and receive information about a treatment cycle from components in the clothes dryer 10 or via input by the user through the user interface 16. The user may enter many different types of information, including, without limitation, cycle selection and cycle parameters, such as cycle options. Any suitable cycle may be used. Non-limiting examples include, Casual, Delicate, Super Delicate, Heavy Duty, Normal Dry, Damp Dry, Sanitize, Quick Dry, Timed Dry, and Jeans.

The controller 14 may implement a treatment cycle selected by the user according to any options selected by the user and provide related information to the user. The controller 14 may also comprise a central processing unit (CPU) 74 and an associated memory 76 where various treatment cycles and associated data, such as look-up tables, may be stored. One or more software applications, such as an arrangement of executable machine-readable commands/instructions may be stored in the memory and executed by the CPU 74 to implement, perform and/or otherwise carry-out the one or more treatment cycles. Example machine-readable instructions that may be executed by the CPU 74 to determine an end-of-cycle condition, and to terminate and/or adjust a drying process based on the end-of-cycle condition are discussed below in connection with FIG. 4.

Figure 4:
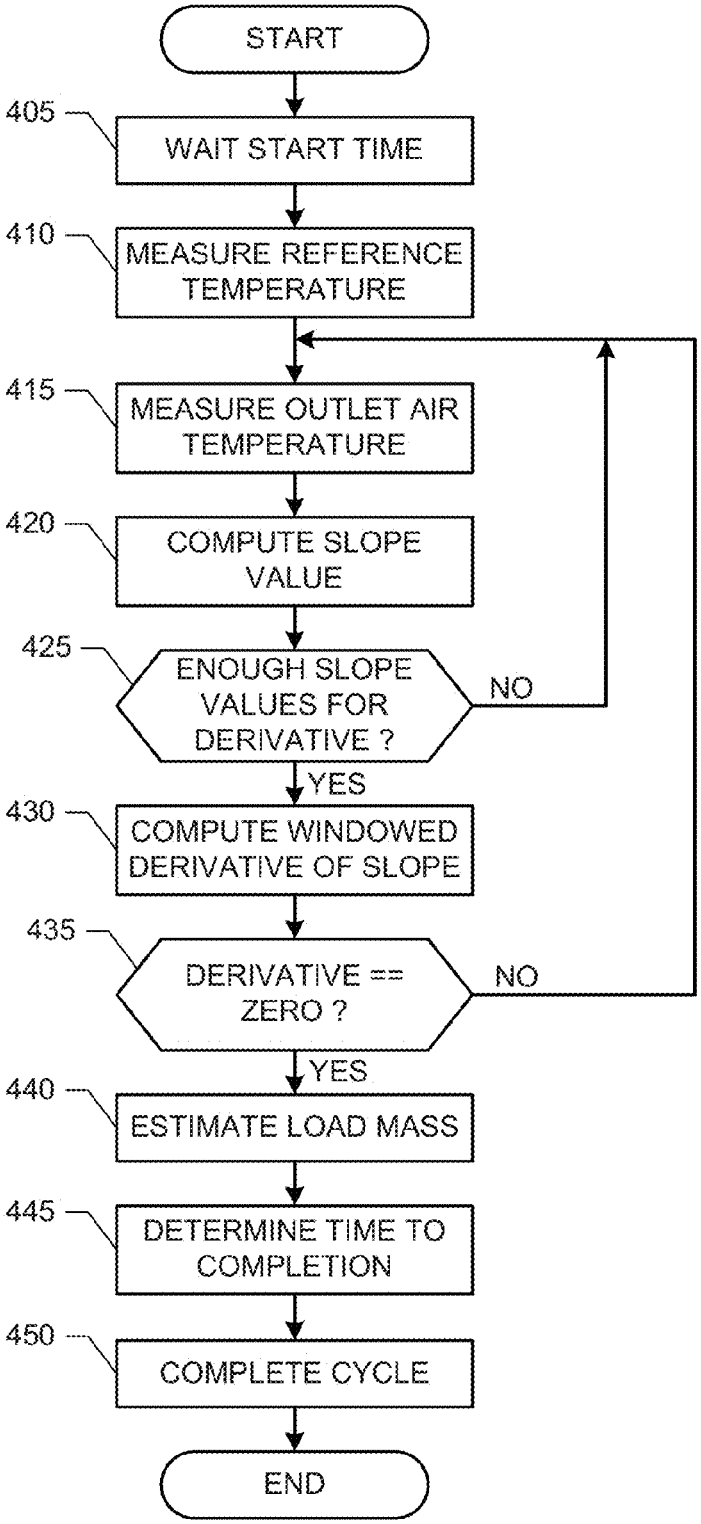
FIG. 4 is a flow chart illustrating an example method of determining an end of cycle condition.
Figure 5:
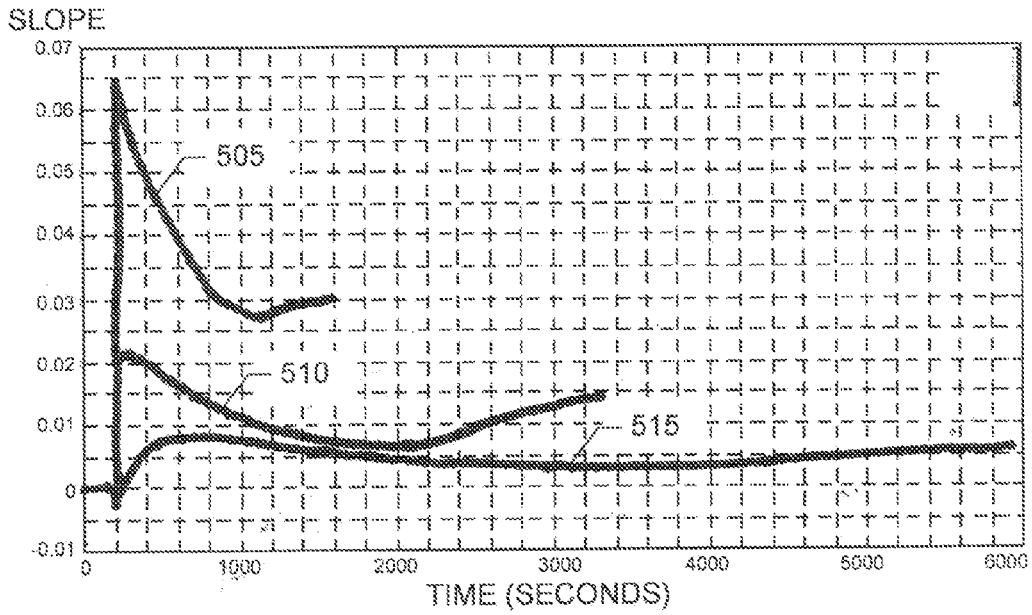
FIG. 5 is a graph depicting example slope curves corresponding to the example exhaust temperature profiles of FIG. 1.
Figure 6:
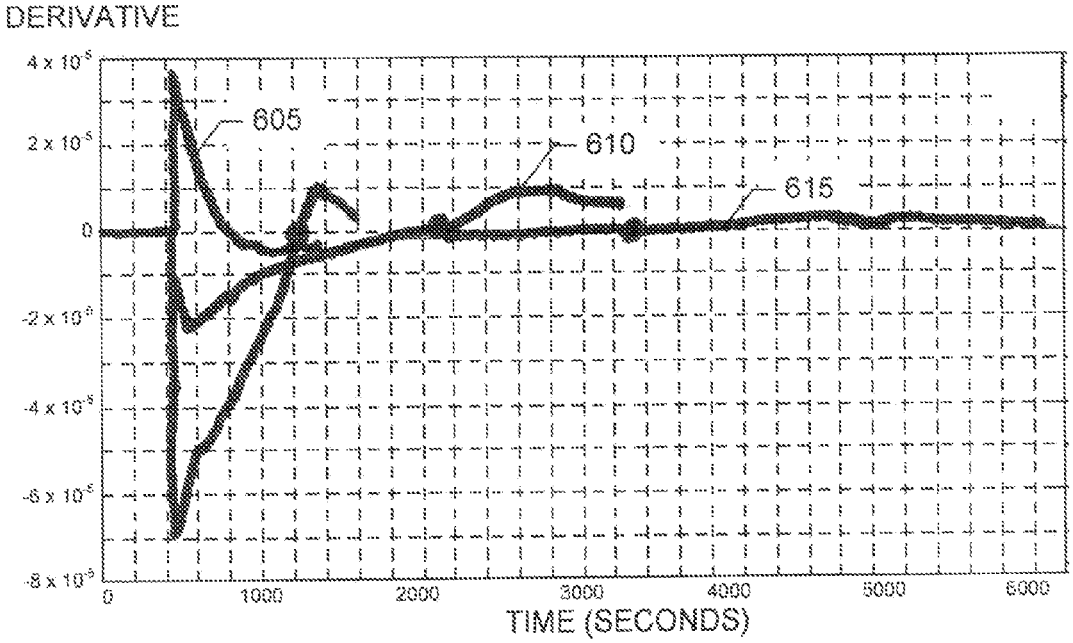
FIG. 6 is a graph depicting example slope derivative curves corresponding to the example slope curves of FIG. 5.

In general, the controller 14 will effect a cycle of operation to effect a treating of the laundry in the treating chamber 34, which may or may not include drying. The controller 14 may actuate the blower 46 to draw an inlet air flow 58 into the supply conduit 38 through the rear vent 37 when air flow is needed for a selected treating cycle. The controller 14 may activate the heating element 42 to heat the inlet air flow 58 as it passes over the heating element 42, with the heated air 59 being supplied to the treating chamber 34. The heated air 59 may be in contact with a laundry load 36 as it passes through the treating chamber 34 on its way to the exhaust conduit 44 to effect a moisture removal of the laundry. The heated air 59 may exit the treating chamber 34, and flow through the blower 46 and the exhaust conduit 44 to the outside of the clothes dryer 10. The controller 14 continues the cycle of operation until completed. If the cycle of operation includes drying, the controller 14 determines when the laundry is dry. FIGS. 4-6 illustrate an example method of determining when laundry is dry.

During a cycle of operation, one or more treating chemistries may be provided to the treating chamber 34 by the dispensing system 57 as actuated by the controller 14. To dispense the treating chemistry, the metering pump 64 is actuated by the controller 14 to pump a predetermined quantity of the treating chemistry stored in the cartridge 60 to the mixing chamber 62, which may be provided as a single charge, multiple charges, or at a predetermined rate, for example. The treating chemistry may be in the form of a gas, liquid, solid, gel or any combination thereof, and may have any chemical composition enabling refreshment, disinfection, whitening, brightening, increased softness, reduced odor, reduced wrinkling, stain repellency or any other desired treatment of the laundry. The treating chemistry may be composed of a single chemical, a mixture of chemicals, or a solution of a solvent, such as water, and one or more chemicals.

FIG. 4 is a flow chart of an example method to determine an end-of-cycle condition and terminate and/or adjust drying of laundry based on the determined end-of-cycle condition. A processor, a controller and/or any other suitable processing device such as the example CPU 74 may be used, configured and/or programmed to execute and/or carry out the example method of FIG. 4. For example, the example method of FIG. 4 may be embodied in program code and/or machine-readable instructions stored on a tangible computer-readable medium such as the memory 76. Many other methods of implementing the example method of FIG. 4 may be employed. For example, the order of execution may be changed, and/or one or more of the blocks and/or interactions described may be changed, eliminated, subdivided, or combined. Additionally, any or all of the example method of FIG. 4 may be carried out sequentially and/or carried out in parallel by, for example, separate processing threads, processors, devices, discrete logic, circuits, etc.

As used herein, the term "tangible computer-readable medium" is expressly defined to include any type of computer-readable medium and to expressly exclude propagating signals. As used herein, the term "non-transitory computer-readable medium" is expressly defined to include any type of computer-readable medium and to exclude propagating signals. Example tangible and/or non-transitory computer-readable medium include a volatile and/or non-volatile memory, a volatile and/or non-volatile memory device, a flash memory, a read-only memory (ROM), a random-access memory (RAM), a programmable ROM (PROM), an electronically-programmable ROM (EPROM), and/or an electronically-erasable PROM (EEPROM).

The method of FIG. 4 starts with the controller 14 waiting a pre-determined amount of time $t_{start}$ to allow the clothes dryer 10 to reach an initial equilibrium (block 405). The controller 14 determines at time $t_{start}$ a reference temperature $T_o$ such as an ambient temperature (block 410), and begins periodically determining (e.g., measuring) exhaust air temperatures using, for example, the example thermistor 51 (block 415). Example exhaust air temperatures 105, 110 and 115 are shown in FIG. 1 for 1 kg, 4 kg and 8 kg laundry masses, respectively.

The controller 14 determines (e.g., computes) a slope of the exhaust air temperatures by computing a difference between a current exhaust air temperature $T_e$ and the reference temperature $T_o$, and computing a product of the difference and an inverse of the time t at which the exhaust air temperature $T_e$ was determined (block 420). The slope of the exhaust air temperatures can be expressed mathematically as $$s(t) = \frac{T_e - T_o}{t}. \qquad \text{EQN (1)}$$

Because the slope expressed in EQN (1) is computed with reference to the reference temperature $T_o$ determined at $t_{start}$ and with a denominator of t, the slope of EQN (1) does not represent a conventional piecewise derivative of the exhaust air temperatures. Example slopes 505, 510 and 515 corresponding to the example exhaust air temperature profiles 105, 110 and 115 of FIG. 1 are shown in FIG. 5. As shown in FIG. 5, the slopes 505, 510 and 515 have a local minima corresponding to the critical moisture content points 100 of FIG. 1. In some examples, a slope value is determined as each exhaust air temperature is determined.

Returning to FIG. 4, to determine (e.g., identifies) the local minima of the slope, the example controller 14 determines (e.g., computes) a derivative of the slope values. A zero-crossing of the slope derivative corresponds to a local minima of the slope. Because the exhaust air temperatures are typically noisy, the slope values will be noisy. To substantially mitigate false determination of a zero-crossing, the derivative of the slope is determined using slope values spaced apart by a window $t_w$. Accordingly, the controller 14 waits until enough initial slope values have been determined before beginning to determine derivatives of the slope (block 425).

Once enough slope values have been determined, the controller 14 begins determining slope derivative values (block 430). In some examples, a new slope derivative value is determined as each slope value is determined. The controller 14 determines (e.g., computes) a slope derivative value by computing a difference between two slope values that are spaced apart by the window $t_w$, which is selected to reduce the occurrence of false zero-crossings, and computing a product of the difference and the inverse of the window $t_w$. The slope derivative can be expressed mathematically as $$\text{derivative} = \frac{s(t) - s(t - t_w)}{t_w}. \qquad \text{EQN (2)}$$

An example value of the window $t_w$ is 250 seconds. Because the example derivative of EQN (2) uses slope values spaced apart by the window $t_w$, the derivative of EQN (2) is referred to herein as a "windowed derivative." In contrast, a conventional derivative is mathematically expressed as $$s'(t) = \frac{s(t) - s(t - \Delta t)}{\Delta t}, \qquad \text{EQN (3)}$$

where Δt is a small value that is substantially smaller than the window $t_w$. The use of a conventional derivative would lead to infrequent false zero-crossing determinations. Example slope derivatives 605, 610 and 615 corresponding to the example slopes 505, 510 and 515 of FIG. 5 are shown in FIG. 6. As shown in FIG. 6, the slope derivatives 606, 610 and 615 have a zero-crossing corresponding to the critical moisture content points 100 of FIG. 1.

Returning to FIG. 4, when the slope derivative of EQN (2) is substantially equal to zero (block 435), the controller 14 determines (e.g., estimates) the mass of the laundry in the laundry drying appliance 14 using, for example, a weight and/or volume sensor (block 440). Based on the determined load mass, the controller 14 determines an additional amount of time and/or parameters to complete the current drying cycle (block 445). For example, a large load (e.g., approximately 8 kg) will be dried for an additional 10 minutes, while a small load (e.g., approximately 1 kg) will be dried for an additional 3 minutes. The controller 14 completes the drying cycle based on the determined time and/or parameters (block 450), and control exits from the example method of FIG. 4.

Returning to block 435, if the derivative slope is not substantially equal to zero (block 435), control returns to block 415 to determine another outlet air temperature.

Returning to block 425, if not enough slope values have been determined to enable the determination of derivative slope values (block 425), control returns to block 415 to determine another air temperature and determine another slope value.

To the extent not already described, the different features and structures of the various embodiments may be used in combination with each other as desired. That one feature may not be illustrated in all of the embodiments is not meant to be construed that it cannot be, but is done for brevity of description. Thus, the various features of the different embodiments may be mixed and matched as desired to form new embodiments, whether or not the new embodiments are expressly described.

Although certain example methods, apparatus and articles of manufacture have been described herein, the scope of coverage of this patent is not limited thereto. On the contrary, this patent covers all methods, apparatus and articles of manufacture fairly falling within the scope of the claims of this patent.

What is claimed is:

1. A method of operating a laundry treating appliance having a treating chamber in which laundry is received for treatment, and a heated air system having a supply conduit coupled to the treating chamber and an exhaust conduit coupled to the treating chamber, the method comprising:

determining a reference temperature of ambient air;

supplying heated air to the treating chamber via the supply conduit;

exhausting air from the treating chamber via the exhaust conduit;

determining exhaust air temperatures of the air exhausted from the exhaust conduit;

determining a windowed derivative of the exhaust air temperature values;

determining a zero crossing of the windowed derivative; and initiating the termination of the supplying of heated air in response to the determination of the zero crossing;

wherein determining the windowed derivative comprises:

computing a first difference between a current exhaust air temperature and the reference temperature;

computing a first elapsed time between a first time associated with the current exhaust air temperature and a second time associated with the reference temperature;

computing a first product of the first difference and the inverse of the first elapsed time;

computing a second difference between a previous exhaust air temperature and the reference temperature;

computing a second elapsed time between a third time associated with the previous exhaust air temperature and the second time;

computing a second product of the second difference and the inverse of the second elapsed time;

computing a third difference between the first and second differences;

computing a fourth difference between the first and third times; and computing the windowed derivative by computing a product of the third difference and the inverse of the fourth difference.

2. A method as defined in claim 1, further comprising selecting the previous exhaust air temperature such that the fourth difference substantially eliminates false determination of the zero crossing.

3. A method as defined in claim 1, further comprising:

determining a load mass;

determining, when the zero crossing is determined, an additional cycle run time based on the determined load mass; and terminating the supplying of the heated air when the additional cycle run time expires.

* * * * *